US008984840B2

(12) United States Patent
Smith

(10) Patent No.: US 8,984,840 B2
(45) Date of Patent: Mar. 24, 2015

(54) METHOD AND SYSTEM FOR REMEDIATING AND COVERING WOOD FLOORS

(75) Inventor: Robert Walter Smith, Bartlett, IL (US)

(73) Assignee: Universal Floor & Wall Systems, Inc., Bartlett, IL (US)

( * ) Notice: Subject to any disclaimer, the term of this patent is extended or adjusted under 35 U.S.C. 154(b) by 184 days.

(21) Appl. No.: 13/479,545

(22) Filed: May 24, 2012

(65) Prior Publication Data

US 2013/0125501 A1 May 23, 2013

Related U.S. Application Data

(63) Continuation-in-part of application No. 12/791,532, filed on Jun. 1, 2010, now Pat. No. 8,327,602.

(60) Provisional application No. 61/276,363, filed on Sep. 14, 2009.

(51) Int. Cl.
*E04B 1/62* (2006.01)
*E04G 23/02* (2006.01)

(52) U.S. Cl.
CPC ..... *E04G 23/0285* (2013.01)
USPC ..... 52/741.4; 52/181; 52/454; 52/514.5; 52/515

(58) Field of Classification Search
CPC ..... E04G 23/02; E04G 23/0203; E04C 1/40; E04B 1/66; C04B 111/00568; C04B 2111/00663
USPC ..... 52/514, 514.5, 515, 741.1, 741.4, 181, 52/443, 446, 454, 361, 362, 363
See application file for complete search history.

(56) References Cited

U.S. PATENT DOCUMENTS

| | | | | |
|---|---|---|---|---|
| 2,246,101 | A | 6/1941 | Mcenany | 428/213 |
| 4,270,329 | A | 6/1981 | Moore | 52/576 |
| 6,716,482 | B2 * | 4/2004 | Morton | 427/201 |
| 6,786,674 | B1 | 9/2004 | Hanks | 44/32 |
| 6,925,766 | B2 | 8/2005 | Di Pede | 52/408 |
| 7,833,575 | B2 * | 11/2010 | Gupta | 427/202 |
| 2004/0200177 | A1 * | 10/2004 | Okumura et al. | 52/633 |
| 2005/0204601 | A1 * | 9/2005 | Kurple et al. | 40/611.02 |

(Continued)

FOREIGN PATENT DOCUMENTS

MX 2008006065 A 10/2005 ..... C09D 163/00

OTHER PUBLICATIONS

PCT Search Report—Jan. 11, 2012.

(Continued)

*Primary Examiner* — William Gilbert
(74) *Attorney, Agent, or Firm* — Niro Haller and Niro

(57) ABSTRACT

A method and system for covering industrial wood plank or wood block floors that can be installed quickly without creating a hazardous environment or hazardous wastes and without the necessity of removing installed equipment. Sand is swept over the wood to fill voids and cracks. Next metal lath is stapled to the wood. A first layer of epoxy is poured onto the metal lath. After this is cured, a second coat of finish epoxy can be installed on the first epoxy layer. When this dries, the job is done and operations can be restarted, or an optional topcoat can be applied. The epoxy material used can be self-leveling for ease of application and the final floor is approximately level. The finished floor is flexible to not crack under heavy loads and to absorb shock.

22 Claims, 6 Drawing Sheets

(56) References Cited

U.S. PATENT DOCUMENTS

2006/0057345 A1 3/2006 Surace et al. ..... 428/213
2008/0092731 A1* 4/2008 Hall ..... 89/36.04
2009/0068473 A1 3/2009 Van Wessel et al. ..... 428/416

OTHER PUBLICATIONS

PCT Opinion on Patentability—Dec. 4, 2012.

* cited by examiner

1. SWEEP SAND OVER WOOD BLOCK TO FILL GAPS
2. LAY METAL LATH - STAPLE TO WOOD
3. APPLY 1ST EPOXY LAYER
4. ALLOW TO DRY
5. APPLY 2ND EPOXY LAYER
6. APPLY AN OPTIONAL TOPCOAT

FIG. 4

DAY 1 - SWEEP WITH FILLER AND APPLY WIRE

DAY 2 - APPLY FIRST AND SECOND EPOXY COATS

DAY 3 - APPLY TOPCOAT

FIG. 5

METHOD AND SYSTEM FOR REMEDIATING AND COVERING WOOD FLOORS

The present invention is a continuation-in-part of co-pending application Ser. No. 12/791,532 filed Jun. 1, 2010 which was a non-provisional application from U.S. Provisional Patent Application No. 61/276,363 filed Sep. 14, 2009. Application Ser. Nos. 12/791,532 and 61/276,363 are hereby incorporated by reference.

BACKGROUND

1. Field of the Invention

The present invention relates generally to the field of remediating, replacing, sealing and covering industrial wooden floors, and more particularly to a method and system that installs a complete epoxy floor system attached to the original wood without the necessity of removing or preparing such floors for sealing and top coating.

2. Description of the Prior Art

Over the years, wood plank floors or wood block floors were installed in numerous commercial and industrial buildings. Many of those floors installed consist of wood blocks or wood planks that are treated with creosote, because creosote-treated wood resists shrinking, insect attack, moisture and decay. Wood floors also reduce sound reflection and provide a softer surface than concrete. Rooms in these buildings usually contain heavy machinery which is mounted to the floor and is in continuous operation. Complete replacement of these floors presents a tremendous problem because all use of the room, including the machinery, must be stopped, and all personnel must be temporarily relocated. Additionally, the large machinery must be removed piece by piece, and finally, the creosote-treated floor must be removed block by block. In the alternative, preparation of the floor for sealing involves sanding or grinding of the creosote coated wood which creates dust and hazardous airborne particles. In general, this is a very laborious process that creates fumes and dust containing creosote chemical components which are harmful to humans. In addition, any treated wood which is removed must be specially disposed of.

Some prior art methods have involved pouring of resinous materials directly on the surface, or, removing the wood and installing approximately three inches of concrete in order to replace the wood block and maintain the proper prior floor height. However, these methods do not work satisfactorily because creosote-treated surfaces resist adhesion, and the thin layer of concrete will crack under heavy loads, and, unless very thick or reinforced, the replacement concrete cannot support heavy traffic or machinery. Concrete replacement also has the disadvantage of a long curing time (28 days) before the floor can be put back into manufacturing use. Also, concrete needs seams for expansion and contraction which is undesirable to the building owners. Finally, concrete replacement adds time and expense to the process by requiring the removal of machinery during remediation. Also, epoxy bonding directly to wood creates a stiff, non-flexible surface that can crack under the shock of heavy loads or objects being dropped. Industrial floors can routinely have to support 500,000 lb. loads. Also, a stiff floor creates foot pain to workers who have to stand on it for long periods.

Epoxy resin is a very desirable material for a floor covering rehabilitation and refurbishment because it cures rapidly and seals; however epoxy will not adhere to treated wood, and if it did, that would be undesirably since the resulting floor would not be flexible. Many new types of high-grade epoxy resins are available that result in floors with high functionality and efficiency. These epoxy resins may contain colors for decorative appearance and can effectively protect steel, concrete and wood from deterioration due to moisture, cracking and, in the case of steel, corrosion. Epoxy resin floors achieve a high degree of watertightness that leads to much longer durability. In general, epoxy yields a floor that is safe, and has a clean, pleasing appearance. It provides a skid-proof surface, even when wet, and is resistant to acids and other aggressive chemicals found in industrial settings. Epoxy floors are also very resistant to abrasion as well as chemical solvents such as gasoline, greases, thawing salts and general solvents. When secured to a wooden subfloor, the epoxy/wood combination provides a softer, resilient and impact-resistant surface.

It would be extremely advantageous to have a method and system where epoxy resin could be rapidly affixed to treated wood plank or wood block floors that solves the problem of adhesion to the covered material; produce a floor surface that would be flexible; and that would not create hazardous airborne material or hazardous waste; and would not require removal of installed machinery and allow workers and production to resume work with minimal down-time.

SUMMARY OF THE INVENTION

The present invention relates to a method and system for remediating creosote or other chemically treated wood flooring by covering existing industrial wood plank or wood block floors quickly without creating a hazardous environment or generating hazardous wastes. The present invention can be installed without the necessity of removing installed equipment and can be completed within a short time frame. The final floor is flexible and is not tightly bonded to the wood. This leaves workers a comfortable substrate to work on, and it absorbs the shock of heavy loads and objects dropped on it. This also eliminates the need for control joints, since if the epoxy was bonded directly to the wood, the floor would have to have control joints to prevent cracking. Using the method and system of the present invention can result in floors over 800 feet long with no control joints.

First, a layer of sand is swept or otherwise laid over the wood to fill voids and cracks. The sand is not mixed with any epoxy, since that would lead to a brittle, non-flexible material. Rather the sand is a dry granular material that can be shoveled and swept. It is very important to fill voids, since any epoxy entering a void would form an anchor and lock the floor to the wood causing it to not be flexible. After the sand layer fills the voids, metal lath is stapled to the wood. A first layer of epoxy is poured on top of, and into, the metal lath. Again, it is very important that the sand is not mixed with the epoxy since this would make the resulting floor system brittle. As stated, the sand effectively keeps epoxy from getting between the wood block. After the first layer of epoxy is dry, a second coat of finish epoxy, possibly colored as desired, is typically spread on the first epoxy layer. When this second layer cures, the job is finished, although specially requested colorings can be added to designate walkways or other special areas. Alternatively, a third epoxy top coat can be applied with stop signs and walkways in place. The epoxy can be self-leveling so that the final floor is approximately level but will still flex under heavy loads. In a particular embodiment, a layer of plastic can optionally be placed over the sand before the lath is put down. In some embodiments of the invention, the second epoxy layer can be omitted.

DESCRIPTION OF THE FIGURES

Attention is now directed to several drawings that illustrate features of the present invention:

FIG. 4. lists the basic steps of the invention.

FIG. 5. lists an example 3-day schedule for a completion job.

Figure 1:
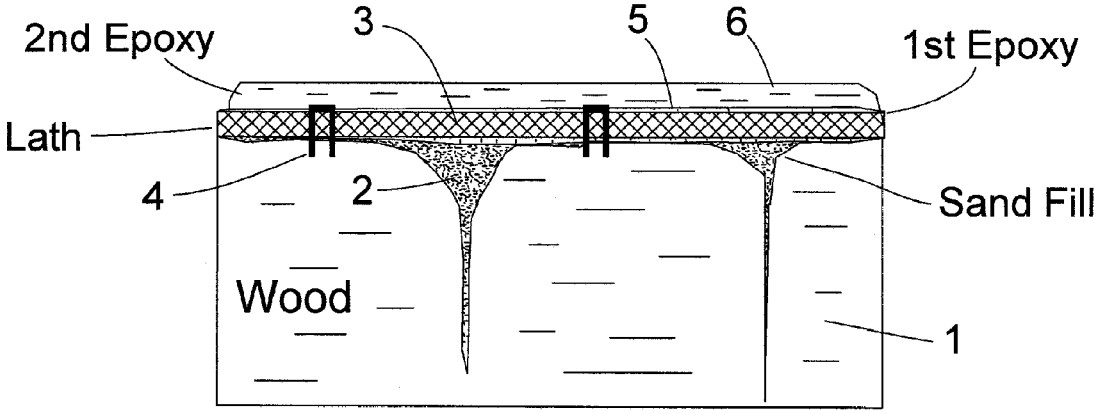
FIG. 1 shows a wood block floor with a sand fill, lath and two epoxy layers.

Several drawings and illustrations have been presented to aid in understanding the present invention. The scope of the present invention is not limited to what is shown in the figures.

DESCRIPTION OF THE INVENTION

The present invention relates to covering, sealing and remediating wooden floors in industrial buildings. The invention can be installed very quickly at a rate of around 10,000 sq. feet in a two day weekend. This high rate of installation minimizes production down-time. The present invention also does not require the removal of existing flooring or installed machinery. Rather, the new floor is laid in with the equipment present. After the final epoxy layer cures, the room is ready for use. Many times, the floor can be covered and remediated over a weekend with workers returning on Monday morning able to resume work as normal. An entire large building can be completed in phases with little or no disruption to ongoing production. The preparation does not involve disturbing the chemically coated wood, or epoxy entering gaps in the wood block. The final floor does not emit undesirable odors or out-gas, will not crack, is impact resistant and resilient to mechanical and thermal shock and has no seams.

Wood plank or wood block floors, in industrial use are usually treated with creosote and usually contain many cracks, pits and voids. Generally, epoxy will not adhere to treated wood in this condition. However, if left unfilled, the voids can trap some epoxy. This is undesirable since it would cause the epoxy to become stiff. The present invention allows the creation of an epoxy floor affixed to and covering such wood plank or wood block.

The first step in the present invention is to sweep sand or other granular material over the planks or blocks to fill in any gaps, voids and spaces between the blocks in order to prevent epoxy from entering any of these voids. While a wide range of sand grits will work, the preferred sand is one that has small enough granules to fill all cracks and voids without creating excessive dust (of a mesh size between approximately 20 and 80 sieve with 50 mesh being preferred). An example of a preferred sand is 50 mesh bank sand called sewing sand and sold by CORRO-SHIELD International, Inc. If the mesh size is too large, undesirable pockets are created; if it is too fine, it creates too much dust and is difficult to handle.

The second step is to lay galvanized metal lath over the wood block. The preferred lath is 4.5 gauge with a 2 inch overlap on each side. The lath can have a range of gauges from around 2.6 gauge to around 4.6 gauge. A 2.6 gauge mesh is the smallest mesh that is typically supplied with a ridge on the bottom. This ridge is important to keep the mesh up off of the wood so that epoxy can flow through holes in the mesh and thus attach to the mesh. Such metal lath can be called ridge-lath. The lath is generally available 2.6 feet by 8 feet sheets. In some embodiments of the present invention, an optional layer of 6 mil plastic sheeting can be laid over the wood and sand before installation of the lath. This optional plastic further acts to separate the first epoxy layer from the surface of the wood.

Next, the metal lath is stapled or otherwise attached to the wood, usually with large metal flooring staples. While any large staple or even nails can be used, the preferred fastener is a staple 2 inches in length. The preferred application of the staples is at least 200 staples per sheet of lath (2.6 feet×8 feet). The staples act to hold the lath firmly to the wood while still allowing it to flex vertically. While staples are the preferred way to hold the lath to the wood, any other fastening technique known in the art may be used including nails, screws with washers and any other means of fastening.

The next step is to apply approximately 3/16 inch to around ¼ inch of self-leveling epoxy, containing 100% solids with an elongation of at least 15-16% over the wire mesh lath. Self-leveling means that the uncured epoxy has a low enough viscosity that when left alone, its surface becomes approximately level. Elongation is really a measure of the cured epoxy's ability to flex. 0% elongation means that the floor is entirely brittle and will crack rather than flex. 100% elongation would bend like a rubber band. An elongation of 15-16% allows just the correct amount of flex to match and mimic the flex of the original wood floor.

The epoxy can be poured onto the mesh and spread with a squeegee or similar device. This allows the epoxy to flow through the wire and onto the plastic, if used. This first layer of epoxy preferably just covers the lath. A preferred epoxy is sold by CORRO-SHIELD International, Inc.

Optionally, when the first epoxy layer is cured and dry, it can be sanded or ground to make sure there is no protruding metal, and that the floor will have a slightly roughened surface for bonding to a second epoxy layer.

The second finishing coat of 100% self-leveling epoxy is laid on the cured first coat. This second coat should also have an elongation of at least 15-16% at a thickness that covers around 35 sq. feet per gallon. The second epoxy layer can be colored if desired. The thickness of the second layer can be similar to that of the first layer. The total epoxy thickness of the finished floor can be adjusted according to the expected load. A lightly loaded floor can have a thickness of from around 7/16 to ⅛ inch, while a heavily loaded floor (heavy machinery on the floor) or around ½ inch. An optional final topcoat of epoxy can be put down with stop signs and walkways in place to provide a final floor system.

As previously stated, the present invention generally does not bond epoxy to the wood; rather, the epoxy bonds to the lath which is held in place by the staples or other fasteners in the wood flooring. It is undesirable for the epoxy to bond to the wood block; the floor of the present invention is flexible and floats. This leaves workers a comfortable substrate to work on, absorbs shock and does not crack or become damaged when objects are dropped on it.

FIG. 1 shows a typical installation of the present invention. A wood block floor 1 is first covered with a layer of sand or other granular material which is swept over the wood to fill any voids 2. Next a metal lath mesh 3 is placed on top of the wood. The metal lath preferably has a small ridge on the bottom side to hold it up just slightly from the wood to help prevent any epoxy from getting into a crack or unfilled pit in the wood. The uncured epoxy generally has enough viscosity to not flow through the holes in the lath 3. Large staples 4 are next driven into the wood through the lath holding the lath in place. Again, typically two hundred 2 inch staples 4 are used for each 2.6 feet by 8 feet sheet of lath. Different sized staples can be used with 2 inch staples being preferred, and different sized lath sheets can also be used. When the lath is installed, it should overlap each side by about 2 inches. After the lath 3 is in place, it is covered with at least one layer of epoxy 5 allowing the epoxy to fill all the voids and mesh area in the lath. After the first epoxy layer 5 cures, it can be optionally sanded or ground to remove any protruding metal from the lath, and to roughen the surface to receive a second epoxy layer 6. A second layer is then applied. When the second epoxy layer 6 cures, the job is complete, or a final topcoat can be applied.

Figure 2:
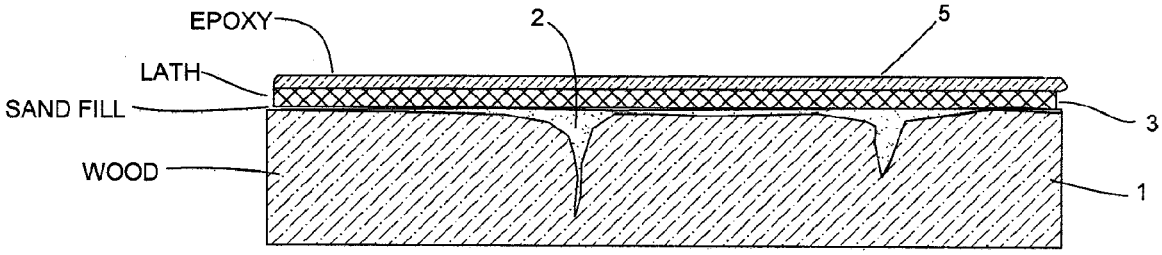
FIG. 2 shows an embodiment of the invention with sand, lath and one epoxy layer.

FIG. 2 shows details of the floor in FIG. 1 with only one epoxy layer. Again wood 1 is first covered and with swept with sand 2 to fill voids, and then metal lath 3 mesh is stapled on top of the wood. The one epoxy layer 5 is applied and covers the lath. In this embodiment, it forms the final floor.

Figure 3:
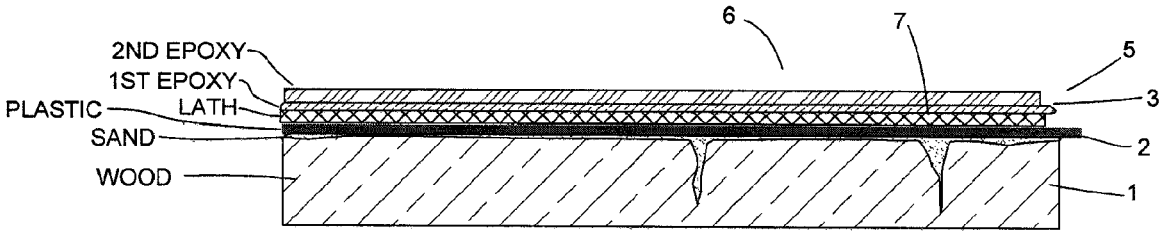
FIG. 3 shows an alternate embodiment with a plastic layer inserted between the wood and metal lath.

FIG. 3 shows an alternate embodiment of the present invention. Sand 2 is swept on top of the wood 1 to fill voids, and a layer of around 6 mil plastic 7 is placed on top of the wood 1. Different thicknesses of plastic can be used with around 6 mil being optimum. Then the lath 3 is stapled on top of the plastic with the staples extending into the wood. Then the first epoxy layer 5 and then the second epoxy layer 6 can be installed. In either FIG. 3 or FIG. 2, the last epoxy finish layer 6 can be omitted if desired. It should be noted that plywood or other material usually cannot be used in place of the plastic, since plywood and similar materials will crush under heavy loads. The preferred method is to put the lath directly on the filled wood as described.

It is also possible in any of the described embodiments for the factory owner to cut trenches in the wooden floor before the job is started. This allows conduit and other piping to be laid out uniformly and in advance of installation of the epoxy. Compared to concrete floors, this is a benefit, since typically the utilities trenches are cut after installation of the concrete increasing cost, dust and manufacturing down time.

FIG. 4 lists five steps that make up a typically application of the method and system of the present invention. Step 1 is to sweep sand over the wood block to fill voids and gaps to prevent epoxy from getting into these voids. Step 2 is to lay metal lath on top of the wood and staple it. Step 3 is to apply the first epoxy layer. Step 4 is allowing the first layer to cure. Step 5 is applying the second epoxy layer. Step 5 can be omitted in some installations, and the first epoxy layer can be optionally ground or sanded after it is dry. Step 6 is optionally applying a topcoat with various stop signs, walkways and the like in place. Also, an optional pre-step before Step 1 is to mark positions of utilities and/or provide utility trenches.

Figure 6:
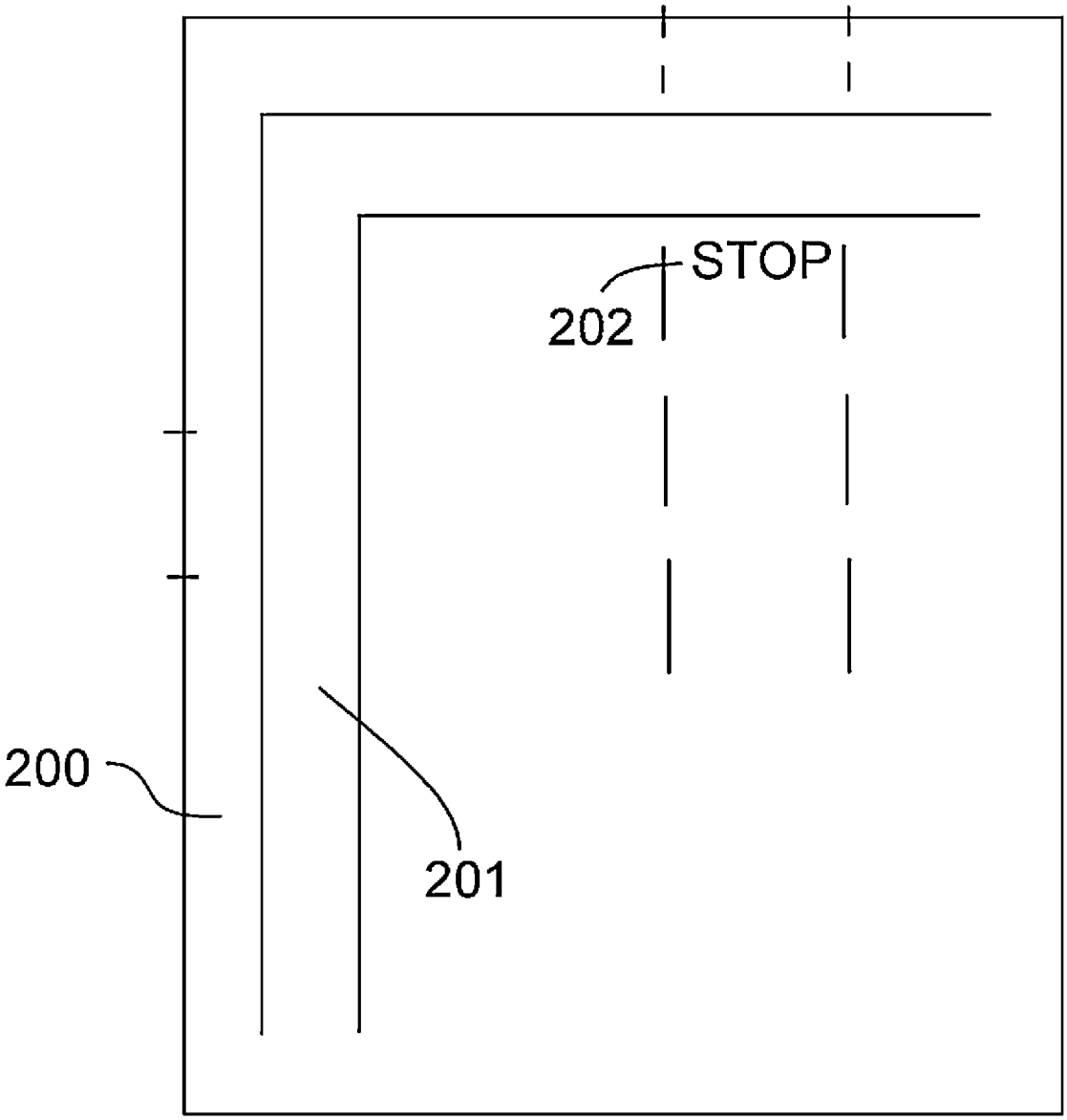
FIG. 6 shows an example of a walkway and stop sign.

The present invention can be implemented on a three-day installation schedule as shown in FIG. 5 as follows: Day 1, Mark utilities, sweep with sand filler and put down and staple wire lath. Day 2: Apply both the first and second coats of epoxy. Day 3: Apply topcoat. This schedule allows work to being on a Friday with the new floor being in place and ready for service by Monday morning. There is thus a fast, efficient installation of a new industrial floor over an old block wood floor with no hazardous waste, no odors, and no need to remove air lines and electrical fittings. FIG. 6 shows an example of walkways a stop signs that are typically put on before the topcoat.

Several descriptions and illustrations have been provided to aid in understanding the present invention. One skilled in the art will realize that numerous changes and variations are possible without departing from the spirit of the invention. Each of these changes and variations is within the scope of the present invention.

I claim:

1. A method for remediating a wood floor comprising:

In a first 24 hour period:

sweeping a material consisting essentially of sand into voids in said wood floor;

fastening ridge-lath to said floor;

applying a first layer of self-leveling epoxy over said ridge-lath;

allowing said first layer to cure;

in a second 24 hour period subsequent said first 24 hour period:

applying a second layer of self-leveling epoxy over said first layer;

allowing said second layer to cure;

in a third 24 hour period subsequent said second 24 hour period:

painting walkways and/or stop signs on said floor;

applying a topcoat layer of epoxy over said second layer after said stop signs and/or walkways are in place painted;

wherein said first, second and topcoat layers of epoxy have 15-16% elongation.

2. The method of claim 1 further comprising sanding or grinding said first layer of epoxy after it cures.

3. The method of claim 1 wherein said lath is fastened to said floor with staples.

4. The method of claim 3 wherein said staples are 2 inch staples.

5. The method of claim 3 wherein said staples are 2 inch staples.

6. The method of claim 5 wherein said lath is 4.5 gauge metal.

7. The method of claim 6 wherein said sand has a mesh size between approximately 20 and 80 sieve.

8. The method of claim 1 wherein said lath is 4.5 gauge metal.

9. The method of claim 1 wherein said sand has a mesh size between 20 and 80 sieve.

10. A method for remediating a wood floor comprising:

first in a first 24 hour period: sweeping a material consisting essentially of sand into voids in said wood floor;

also in said first 24 hour period, fastening metal lath to said floor;

in a second 24 hour period subsequent said first 24 hour period: applying a first layer of epoxy over said metal lath, and allowing said first layer to cure;

also in said second 24 hour period, applying a second layer of epoxy over said first layer, and allowing said second layer to cure;

in a third 24 hour period subsequent said second 24 hour period: painting walkways and/or stop signs on said floor;

also in said third 24 hour period, applying a topcoat of epoxy after said stop signs and/or walkways are painted.

11. The method of claim 10 wherein said metal lath is fastened to said floor with staples.

12. The method of claim 11 wherein said staples are 2 inch staples.

13. The method of claim 11 wherein said lath is 4.5 gauge metal.

14. The method of claim 13 wherein said epoxy is self-leveling of at least 15-16% elongation.

15. The method of claim 14 wherein said sand has a mesh size between approximately 20 and 80 sieve.

16. The method of claim 13 wherein said metal lath has a small ridge on its underside.

17. The method of claim 10 wherein said lath is 4.5 gauge metal.

18. The method of claim 10 wherein said epoxy is self-leveling of at least 15-16% elongation.

19. The method of claim 10 wherein said metal lath has a small ridge on its underside.

20. The method of claim 10 further comprising sanding or grinding said first layer of epoxy after it cures before said second layer of epoxy is applied.

21. The method of claim 10 wherein said sand has a mesh size between approximately 20 and 80 sieve.

22. A method for remediating a wood floor comprising:

in a first 24 hour period, sweeping a material consisting essentially of sand into voids in said wood floor;

also in said first 24 hour period, fastening metal lath to said floor;

in a second 24 hour period subsequent said first 24 hour period: applying a first layer of epoxy over said metal lath, and allowing said first layer to cure;

also in said second 24 hour period, applying a second layer of epoxy over said first layer, and allowing said second layer to cure;

wherein said epoxy is self-leveling of at least 15-16% elongation;

and wherein said sand has a mesh size between approximately 20 and 80 sieve.

* * * * *